US009707427B2

(12) United States Patent
Davis et al.

(10) Patent No.: US 9,707,427 B2
(45) Date of Patent: Jul. 18, 2017

(54) VAULT SHAPED MINIATURE TRAMPOLINE

(71) Applicants: Douglas M. Davis, Port Townsend, WA (US); Caroline Lennox, Port Townsend, WA (US); James Parent, Mt. Pleasant, MI (US); Kyle Thalman, Reno, NV (US); William Duddles, Lake City, MI (US)

(72) Inventors: Douglas M. Davis, Port Townsend, WA (US); Caroline Lennox, Port Townsend, WA (US); James Parent, Mt. Pleasant, MI (US); Kyle Thalman, Reno, NV (US); William Duddles, Lake City, MI (US)

( * ) Notice: Subject to any disclaimer, the term of this patent is extended or adjusted under 35 U.S.C. 154(b) by 0 days.

(21) Appl. No.: 14/735,697

(22) Filed: Jun. 10, 2015

(65) Prior Publication Data

US 2015/0360067 A1 Dec. 17, 2015

Related U.S. Application Data

(60) Provisional application No. 62/010,460, filed on Jun. 11, 2014.

(51) Int. Cl.
*A63B 5/08* (2006.01)
*A63B 5/11* (2006.01)

(52) U.S. Cl.
CPC ..... *A63B 5/11* (2013.01); *A63B 5/08* (2013.01); *A63B 2005/085* (2013.01); *A63B 2209/10* (2013.01); *A63B 2210/50* (2013.01); *A63B 2244/08* (2013.01); *A63B 2244/12* (2013.01)

(58) Field of Classification Search
CPC ..... A63B 5/08–5/11
See application file for complete search history.

(56) References Cited

U.S. PATENT DOCUMENTS 4,045,021 A * 8/1977 Nissen ..... A63B 5/11 482/29
4,331,329 A * 5/1982 Mirkovich ..... A63B 5/11 482/27
4,730,826 A * 3/1988 Sudmeier ..... A63B 5/11 482/28

(Continued)

*Primary Examiner* — Joshua Lee
*Assistant Examiner* — Jennifer M Deichl
(74) *Attorney, Agent, or Firm* — Dale J. Ream

(57) ABSTRACT

A miniature trampoline includes a frame having at least a pair of spaced apart upper frame members each having an upper front end and an upper rear end, respectively, the upper frame members being inclined toward the upper rear ends, respectively. A trampoline bed includes at least one planar surface and a pair of elongate side edges situated between the upper frame members and extending substantially between the upper rear ends and upper front ends of the pair of upper frame members, respectively. The trampoline includes a plurality of springs, each spring having a spring fastener coupled to a respective upper frame member and a bed fastener coupled to the trampoline bed proximate a side edge thereof, wherein the springs are spaced apart along the respective upper frame members, respectively, such that the trampoline bed is selectively held in tension between the upper frame members, respectively.

5 Claims, 12 Drawing Sheets

(56) References Cited

U.S. PATENT DOCUMENTS

| | | | | | |
|---|---|---|---|---|---|
| 5,370,591 | A * | 12/1994 | Jewell | A63B 5/08 | 482/26 |
| 5,967,943 | A * | 10/1999 | Rich | A63B 5/11 | 182/37 |
| 2013/0196833 | A1 * | 8/2013 | Strickland | A63B 21/025 | 482/131 |

* cited by examiner

VAULT SHAPED MINIATURE TRAMPOLINE

REFERENCE TO RELATED APPLICATION

This non-provisional patent application claims the benefit of provisional application Ser. No. 62/010,460 filed on Jun. 10, 2014, titled Vault Shaped Miniature Trampoline aka T-trainer.

BACKGROUND OF THE INVENTION

The present invention relates generally to trampolines and more specifically it relates to a vault shaped miniature trampoline, also referred to as a "T-trainer" for the reduction of stress on joints when vaulting or tumbling.

In general, a "trampoline" refers to a device having a strong fabric stretched tightly over a metal frame using coiled springs. People may then bounce vertically on the fabric for recreational or competitive purposes. More specifically, a springboard or vault is a more particular trampoline frequently used in competitive gymnastics to propel a gymnast further or with greater velocity than if she had jumped from a fixed platform without springs.

Various devices have been proposed in the art for providing trampoline devices in the form of a vault to facilitate gymnasts launching themselves with feet or hand takeoffs. Although presumably effective for their intended purposes, the existing devices are less effective as training devices or to enable a broad range of uses needed by young athletes learning gymnastics.

Therefore, it would be desirable to have a vault shaped miniature trampoline for the reduction of stress on joints when vaulting or tumbling, especially for foot or hand take offs.

BRIEF SUMMARY OF THE INVENTION

A miniature trampoline according to the present invention includes a frame having at least a pair of spaced apart upper frame members each having an upper front end and an upper rear end, respectively, the upper frame members being inclined toward the upper rear ends, respectively. A trampoline bed includes at least one planar surface and a pair of elongate side edges situated between the upper frame members and extending substantially between the upper rear ends and upper front ends of the pair of upper frame members, respectively. The trampoline includes a plurality of springs, each spring having a spring fastener coupled to a respective upper frame member and a bed fastener coupled to the trampoline bed proximate a side edge thereof, wherein the springs are spaced apart along the respective upper frame members, respectively, such that the trampoline bed is selectively held in tension between the upper frame members, respectively.

Therefore, a general object of this invention is to provide a vault shaped miniature trampoline for the reduction of stress on joints when vaulting or tumbling. Specifically designed for foot or hand take offs.

Another object of this invention is to provide a miniature trampoline, as aforesaid, that has a lightweight aluminum frame.

Still another object of this invention is to provide a miniature trampoline, as aforesaid, that uses specifically designed 4" long springs.

A further object of this invention is to provide a miniature trampoline, as aforesaid, that is shaped like the top of a vault so that it may be used as a vault top to reduce stress on wrists and hands takeoff maneuvers.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

DETAILED DESCRIPTION OF THE PREFERRED EMBODIMENT

Figure 1:
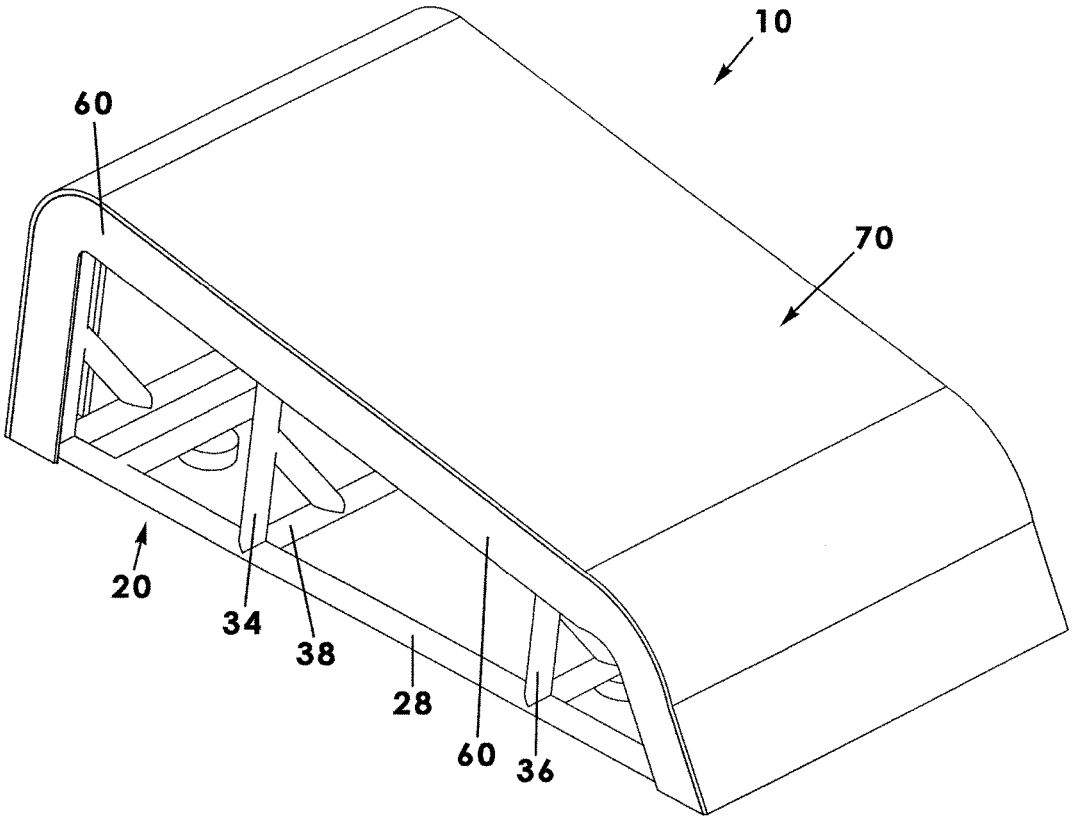
FIG. 1 is an upper perspective view of miniature trampoline according to a preferred embodiment of the present invention.

A vault shaped miniature trampoline (also referred to as "the trampoline") according to the present invention will now be described in detail with reference to FIGS. 1 to 12 of the accompanying drawings. The trampoline 10 includes a frame 20 having upper frame members 22 and lower frame members 28, a trampoline bed 40, and a top cover 70.

In an embodiment, the frame 20 may be constructed of aluminum 6061 T4 tubes welded together although other strong and durable materials may also work for the intended purposes. The tubes may be constructed of Aluminum 6061-T4 or Aluminum 6061-T6. Depending on type of aluminum, the tubes may be 1.5" to 1" diameter ¼" thickness.

In general, the frame 20 is arranged in the form of a vault table. More particularly, the frame 20 includes a pair of upper frame members 22 and a pair of lower frame members 28. The upper frame members 22 are laterally spaced apart and parallel to one another, each upper frame member 22 having an upper front end 24 and an upper rear end 26, respectively.

The frame 20 also includes a pair of lower frame members 28, the lower frame members 28 being spaced apart from and parallel to each other. Each lower frame member 28 includes a lower front end 30 and a lower rear end 32. The frame 20 also includes a pair of rear side support members 34, each extending between respective lower frame members and respective upper frame members 22. Similarly, the frame 20 includes a pair of front side support members 36, each extending between respective lower frame members and respective upper frame members 22. Importantly, the rear side support members 34 include a length that is greater than a length of the front side support members 36 such that the upper frame members 22 are inclined in the direction toward the upper rear ends of the upper frame members 22. In fact, the upper front ends 24 are coupled to the lower front ends 30, respectively, and the upper rear ends 26 are vertically displaced from lower rear ends 32. A top surface of the upper frame members 22 define a plurality of apertures 23, the apertures being spaced apart along the upper frame members 20 substantially between respective upper rear ends 26 and upper front ends 24.

Further, the frame 20 includes at last a pair of laterally spaced apart struts 38 that extend between respective lower frame members 28. A plurality of "footers" 39 are coupled to a bottom of respective struts 38 and positioned to face downwardly, i.e. to contact a ground or floor surface. The footers 39 are distributed evenly such that the frame 20 is supported atop the plurality of footers 39 in a level arrangement. Preferably, the footers 39 are constructed of rubber to keep the frame 20 from slipping on the floor. The footers 39 may be glued to the respective struts 38 although other attachment means may also work.

Figure 2:
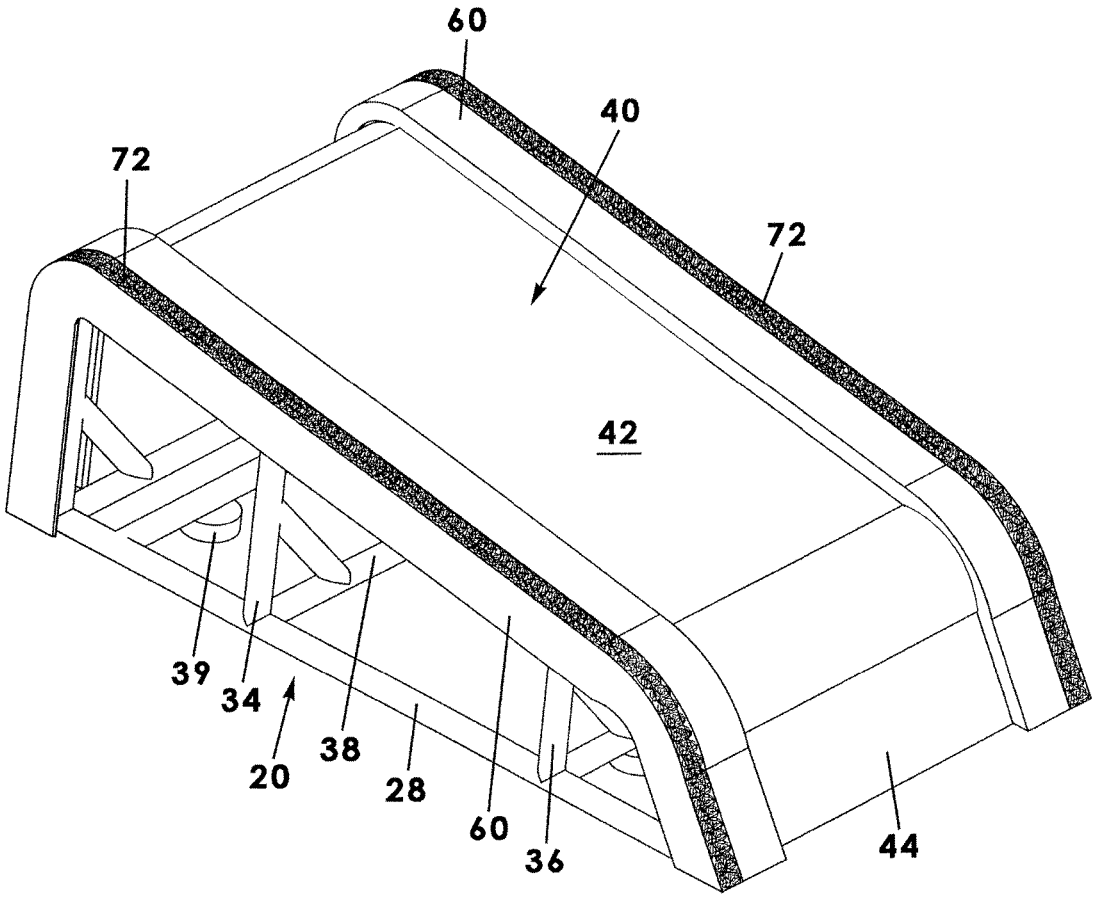
FIG. 2 is a perspective view of the trampoline as in FIG. 1 with a top cover removed.
Figure 3:
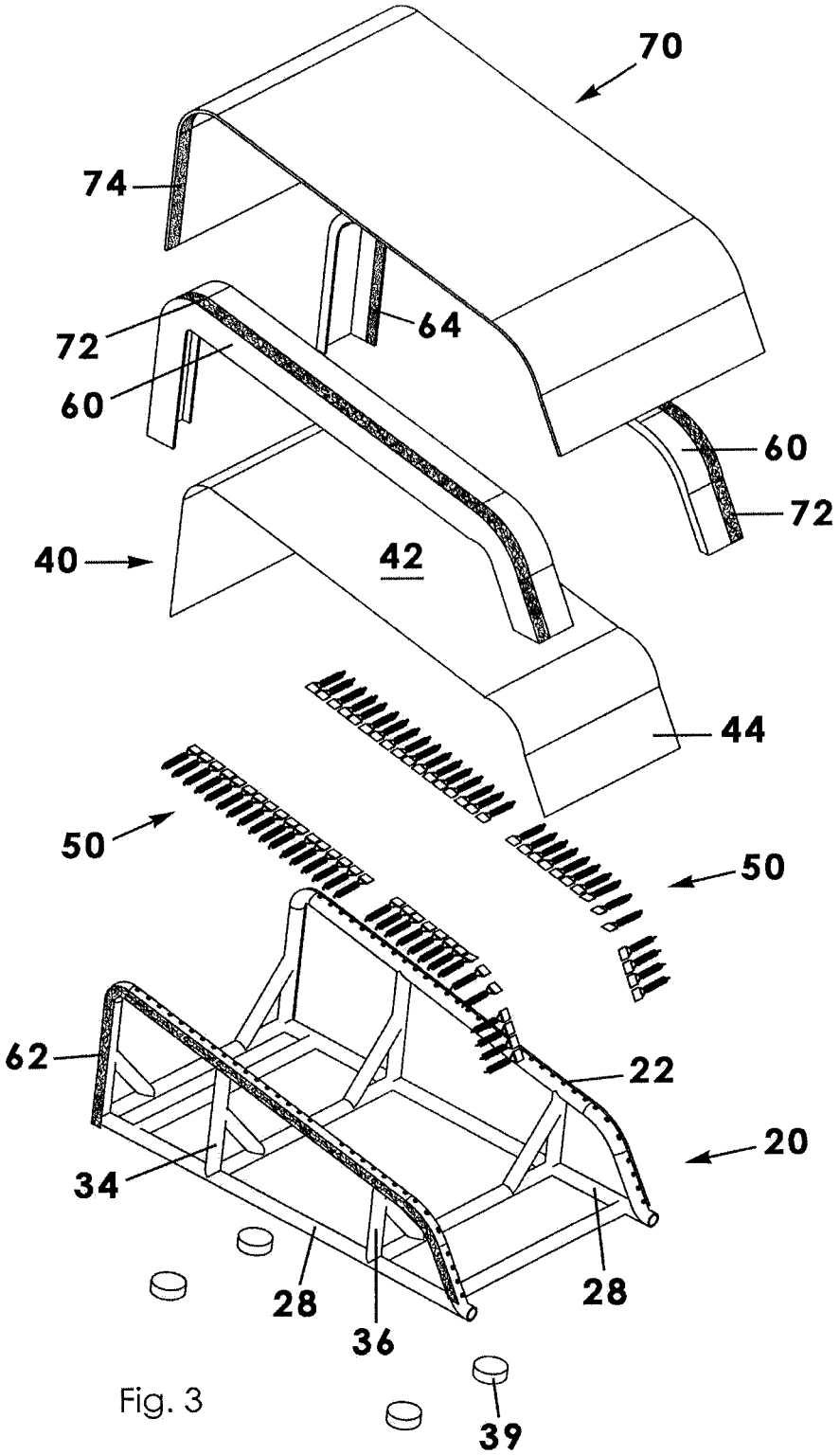
FIG. 3 is an exploded view of the trampoline as in FIG. 1.
Figure 6:
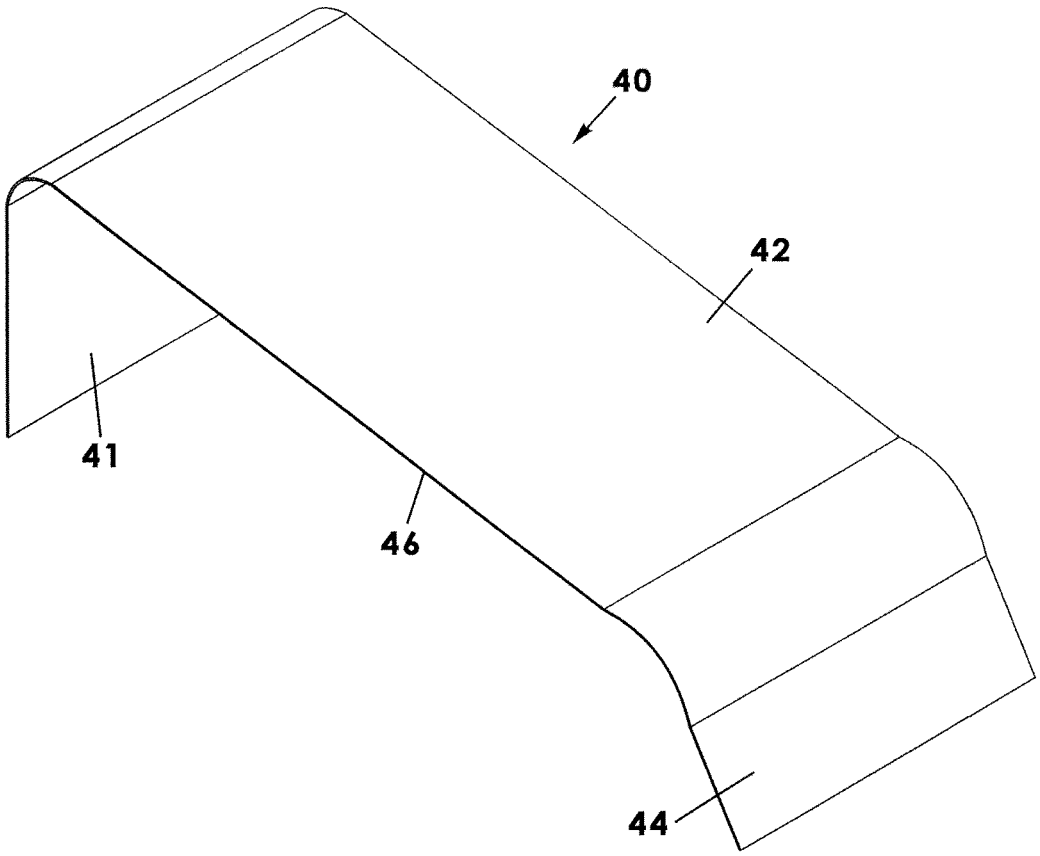
FIG. 6 is an isolated view of a trampoline bed removed from the trampoline as in FIG. 2.
Figure 7:
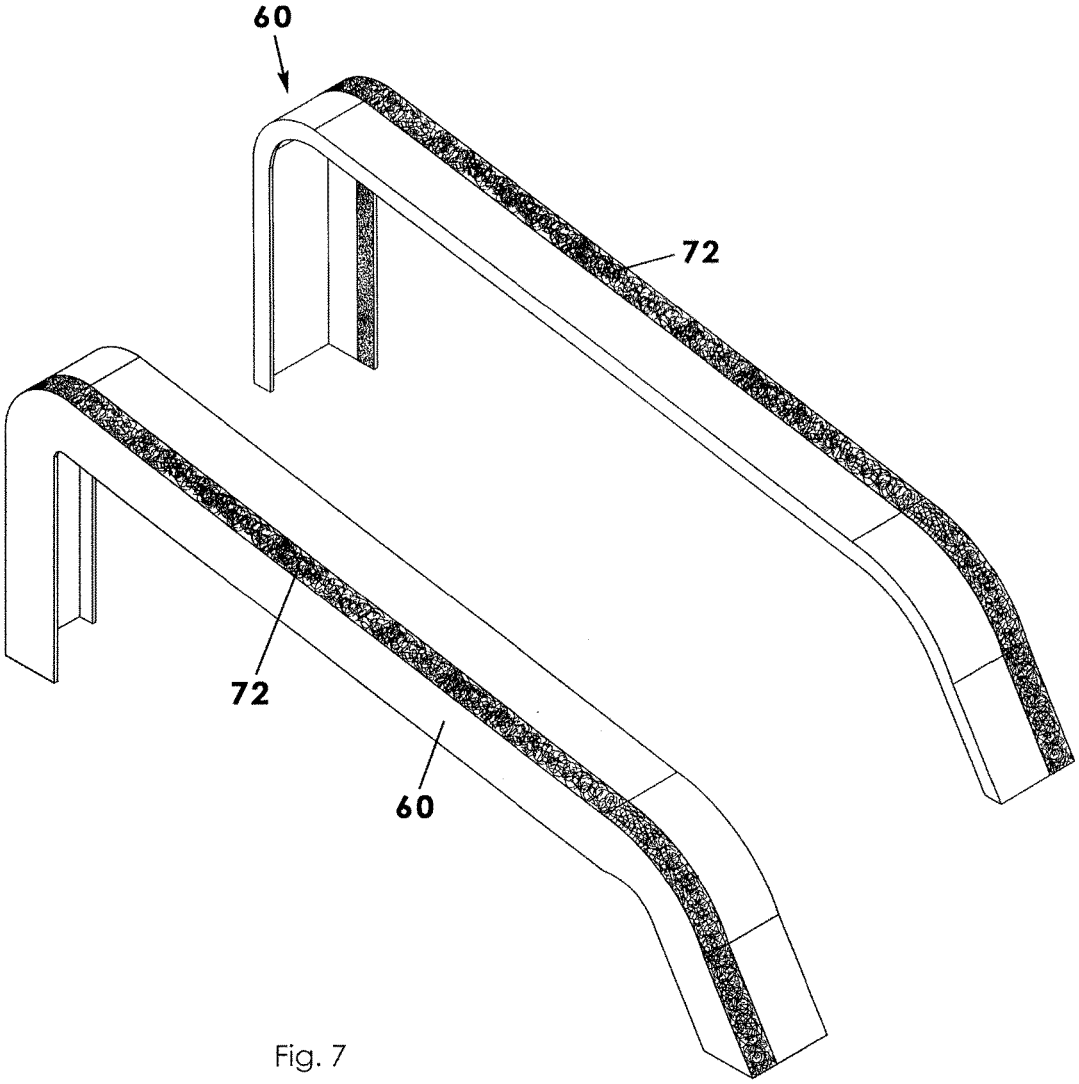
FIG. 7 is an isolated view of the safety pads removed from the trampoline as in FIG. 2.
Figure 8:
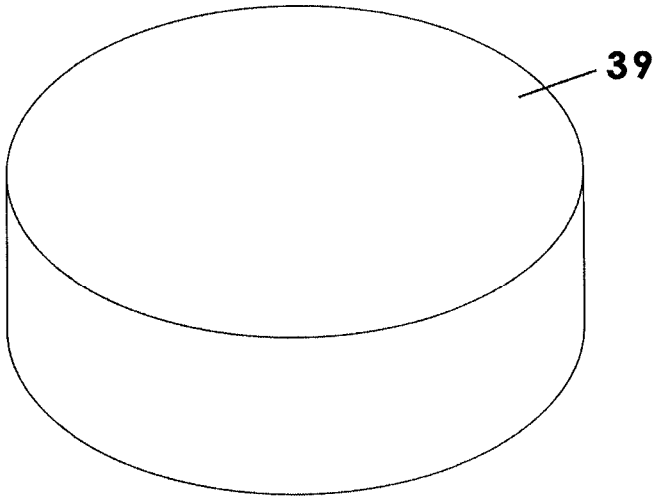
FIG. 8 is an isolated view of a footer removed from the trampoline as in FIG. 2.
Figure 9:
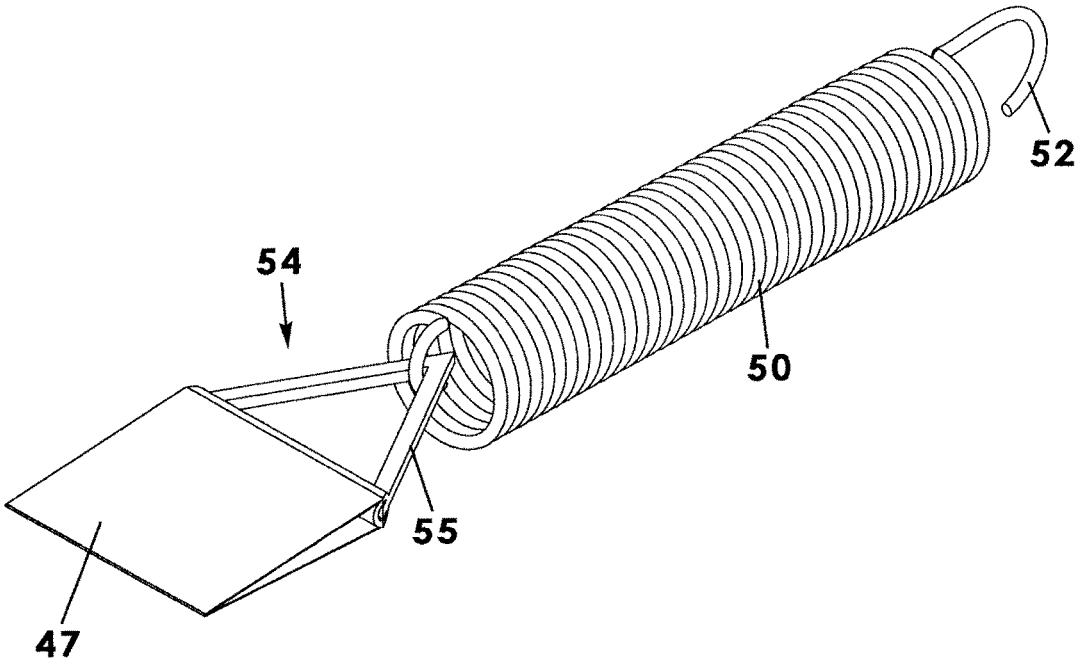
FIG. 9 is an isolated view of a spring removed from the trampoline as in FIG. 3.
Figure 10A:
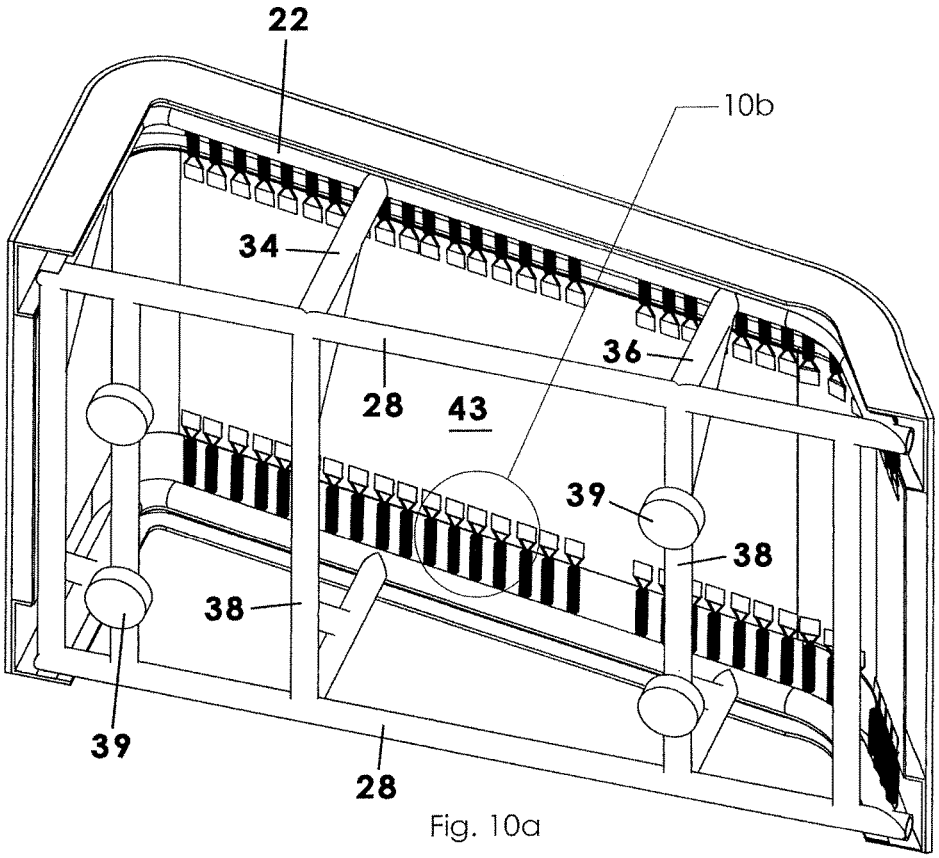
FIG. 10*a* lower perspective view of the trampoline as in FIG. 2.
Figure 10B:
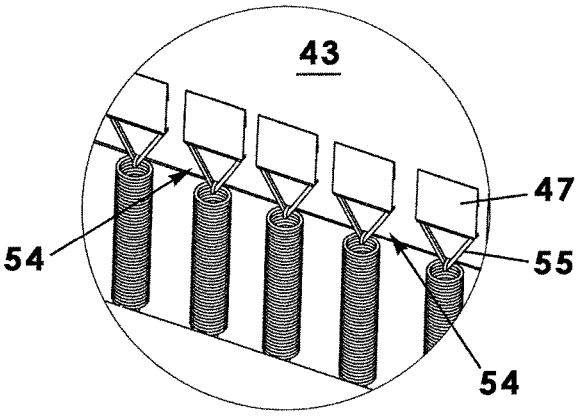
FIG. 10*b* is an isolated view on an enlarged scale taken from FIG. 10A.
Figure 11A:
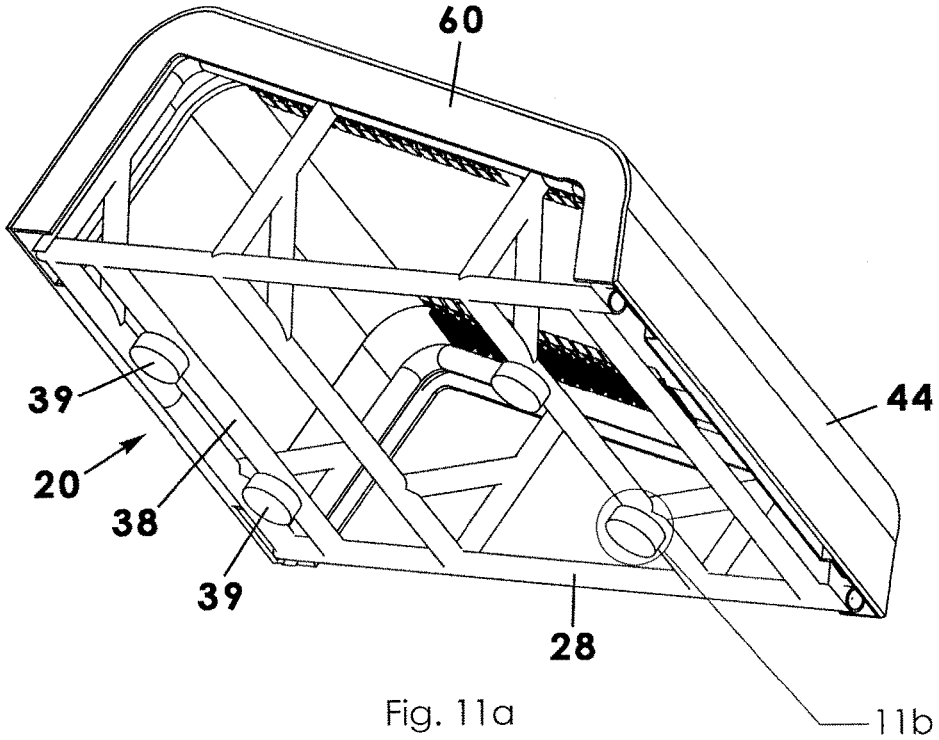
FIG. 11*a* is another lower perspective view of the trampoline as in FIG. 2.
Figure 11B:
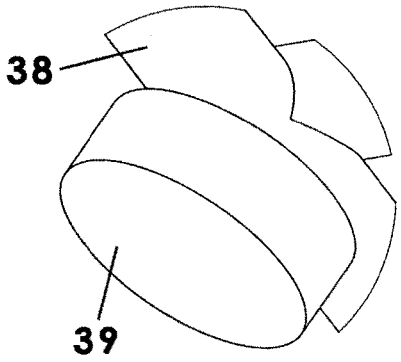
FIG. 11*b* is an isolated view on an enlarged scale taken from FIG. 11*a*.
Figure 12:
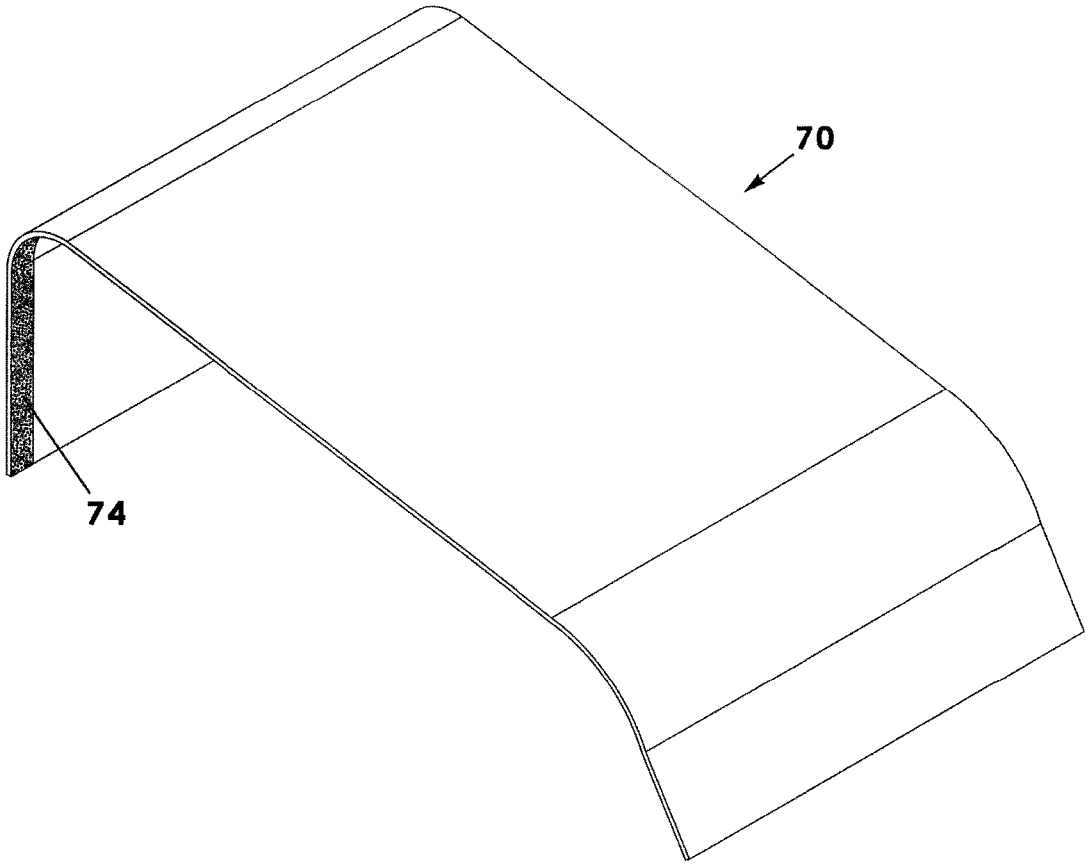
FIG. 12 is an isolated view of the top cover of FIG. 3.

The trampoline bed 40 includes at least one planar surface, such as a flat body portion 42 extending from respective upper rear ends 26 of respective upper frame members 22 and extending in the direction of respective upper front ends 24. The trampoline bed 40 may also include a front portion 44 more proximate the upper front ends 24 (FIG. 2). The trampoline bed 40 is laterally bounded by parallel side edges 46 that are displaced from actual contact with respective upper frame members 20. Preferably, the trampoline bed 40 may be constructed of polypropylene webbing having a vinyl top surface and an opposed bottom surface 43. The construction of the trampoline bed 40 is to reduce impact stress on athletes using the product in acrobatic maneuvers. The trampoline bed 40 may also include a rear portion 41 extending downwardly from upper rear ends 26 of the upper frame member 22, the rear portion 41 being configured to substantially cover the open rear end of the frame 20 (FIGS. 2, 3, and 6).

Each spring 50 of the plurality of springs 50 has, at one end, a spring fastener 52 and, at an opposite end, a bed fastener 54. Each spring fastener 52 is a flange—such as a pin or post or clasp—that is selectively received by a corresponding aperture 23 of a respective upper frame member 22. Each bed fastener 54 may include a triangular metal ring 55 that is fixedly attached to a bottom surface 43 of the trampoline bed 40 proximate respective side edges 46, such as by sewing although other forms of attachment would also be suitable. Preferably, each spring is a tension spring such that the trampoline bed is suspended and held in tension between the upper frame members 22.

Figure 4:
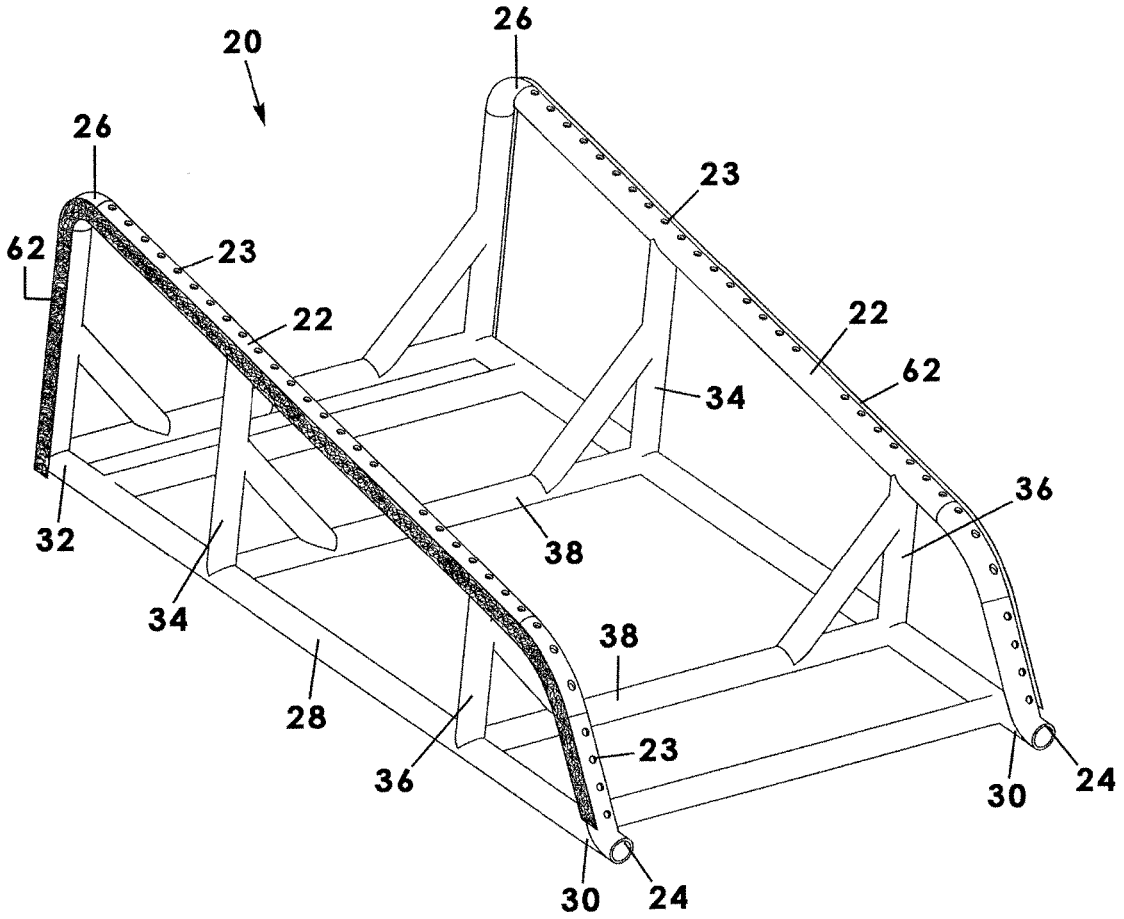
FIG. 4 is an isolated perspective view of the frame of the trampoline.
Figure 5A:
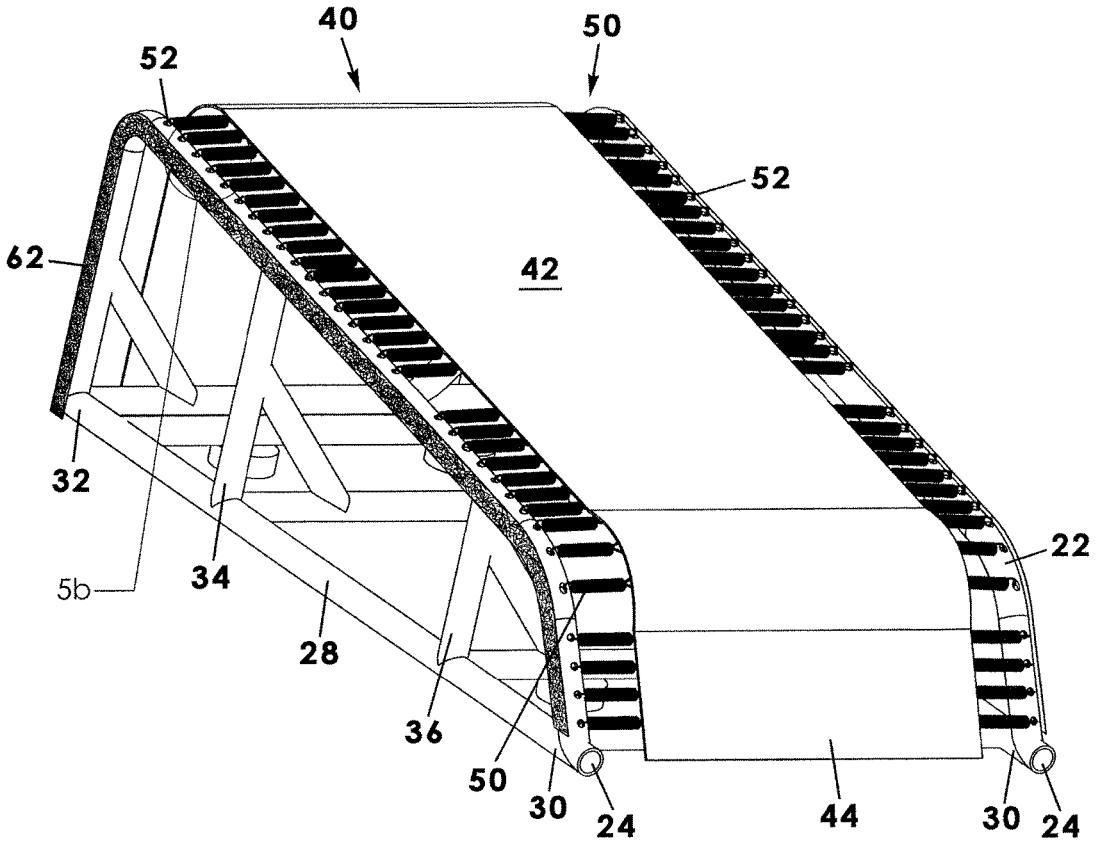
FIG. 5*a* is a perspective view of the trampoline as in FIG. 2 with the pair of safety pads removed.
Figure 5B:
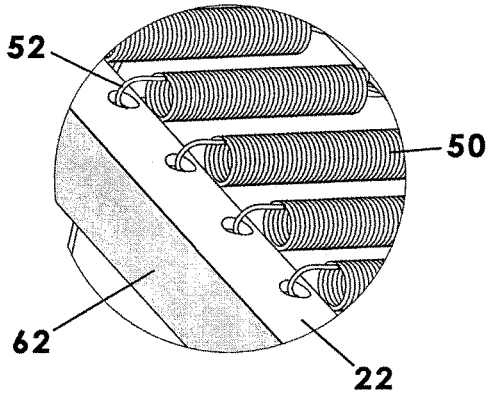
FIG. 5*b* is an isolated view on an enlarged scale taken from FIG. 5*a*.

The trampoline 10 includes a pair of safety pads 60 selectively and removably coupled to the frame 20 and situated to cover and prevent access to the plurality of springs 50 (FIG. 2). Preferably, each safety pad 60 extends substantially between respective upper rear ends 26 and respective upper front ends 24. For instance, it is desirable to cover the plurality of springs 50 so as to prevent injury to an athlete who inadvertently may make contact with the trampoline bed 40 a little wide of an intended point of contact. Each safety pad 60 may have an elongate and narrow configuration. A first hook and loop fastening strip 62 may be mounted and positioned along respective upper frame members 22, respectively (FIG. 4). An inner surface of each safety pad 60 includes a corresponding second hook and loop fastening strip 64 that is complementary to the first hook and loop fastening strip 62. Accordingly, the first and second fastening strips are selectively coupled together when respective safety pads 60 are positioned atop respective upper frame members 22.

In another aspect, the trampoline 10 includes a top cover 70 that is operatively and removably coupled to the trampoline bed 40. The top cover 70 is made of EVA foam that is covered with suede on the top and vinyl on the bottom. The top cover 70 is congruent to the shape of the trampoline bed 40 but defines a larger geometric area such that the trampoline bed 40 is substantially covered when laid atop the trampoline bed 40. The top cover 70 may be removably coupled to respective safety pads 60 with hook and loop fasteners. More particularly, a third hook and loop fastening strip 72 may extend along a top or side surface of each safety pad 60. Correspondingly, a fourth hook and loop fastening strip 74 that is complementary to the third hook and loop fastening strip is coupled to a bottom surface of the top cover 70. The third and fourth hook and loop fastening strips may be selectively engaged so as to couple the top cover 70 to the safety pads 60 and so the top cover 70 may be removed quickly and easily when desired. Preferably, the top cover 70 includes ethylene-vinyl acetate ("EVA") foam material that is configured to simulate a gymnastics vaulting table.

The miniature trampoline 10 may be positioned at a desired position on the floor, such as in a gymnastics training facility. The trampoline 10 can be assembled with the top cover 70 secured atop the trampoline bed 40 or removed, as described above. In use, the miniature trampoline 10 may used by athletes to perform acrobatic maneuvers. The device may be used as a substitute springboard or if placed on block can be used as a substitute gymnastics vaulting table. The acrobatic maneuvers can be a foot or hand take off variety. The springs 50 are held under tension between the frame 20 and the trampoline bed 40. When an athlete jumps off or does a hands first takeoff from the bed 40, the tension is transferred to the upward motion of the athlete. Because of the shape and size of the frame 20 and the springs 50, the stress on joints from the takeoff are less that on a regular springboard, mini-trampoline, or gymnastics vaulting table.

It is understood that while certain forms of this invention have been illustrated and described, it is not limited thereto except insofar as such limitations are included in the following claims and allowable functional equivalents thereof.

We claim:

1. A miniature trampoline, comprising:

a frame having at least a pair of spaced apart upper frame members each having an upper front end and an upper rear end, respectively, said upper frame members being inclined toward said upper rear ends, respectively;

a trampoline bed having at least one planar surface and a pair of elongate side edges situated between said upper frame members and extending substantially between said upper rear ends and upper front ends of said pair of upper frame members, respectively;

a plurality of springs, each spring having a spring fastener coupled to a respective upper frame member and a bed fastener coupled to said trampoline bed proximate a side edge thereof, wherein said springs are spaced apart along said respective upper frame members, respectively, such that said trampoline bed is selectively held in tension between said upper frame members, respectively;

a top cover selectively and operatively coupled to said trampoline bed and situated to completely cover said trampoline bed, said top cover having a shape configuration that is congruent to a shape configuration of said trampoline bed and defining a mathematical area that is larger than a mathematical area of said trampoline bed;

wherein:

said top cover is removably coupled to said trampoline bed with corresponding hook and loop fasteners; and said top cover is constructed of ethylene-vinyl acetate ("EVA") foam material and configured to simulate a gymnastics vaulting table.

2. The miniature trampoline as in claim 1, wherein said frame includes:

a pair of rear side support members extending upwardly between respective lower frame members and respective upper frame members;

a pair of front side support members extending upwardly between respective lower frame members and respective upper frame members, wherein said rear side support members have a length that is greater than a length of said front side support members such that said upper support members are inclined toward said upper rear ends of said upper support members, respectively.

3. The miniature trampoline as in claim 1, wherein each of said plurality of springs is a tension spring and configured to apply tension between said trampoline bed and said upper frame members when coupled thereto.

4. The miniature trampoline as in claim 1, wherein:

each upper frame member defines a plurality of apertures spaced apart therealong between said upper rear end and said upper front end, respectively;

each spring fastener includes a flange selectively received in a respective aperture of a respective upper frame member; and said bed fastener is a ring fixedly attached to said bottom side of said trampoline bed proximate a side edge thereof.

5. The miniature trampoline as in claim 1, comprising a pair of safety pads mounted atop said upper frame members, respectively, each safety pad having an elongate configuration extending between said upper rear ends and said upper front ends, respectively, each safety pad dimensioned to prevent contact with said plurality of springs.

* * * * *